United States Patent [19]

Kusuda

[11] Patent Number: 5,025,288

[45] Date of Patent: Jun. 18, 1991

[54] IMAGE FORMING APPARATUS CAPABLE OF PREVENTING SIMULTANEOUS ROTATION OF THE MAGNET ROLL AND THE DEVELOPING SLEEVE

[75] Inventor: Yasuhiro Kusuda, Osaka, Japan

[73] Assignee: Minolta Camera Kabushiki Kaisha, Osaka, Japan

[21] Appl. No.: 429,650

[22] Filed: Oct. 31, 1989

[30] Foreign Application Priority Data

| | | | |
|---|---|---|---|
| Nov. 1, 1988 | [JP] | Japan | 63-278352 |
| Nov. 21, 1988 | [JP] | Japan | 63-294216 |
| Nov. 21, 1988 | [JP] | Japan | 63-294217 |

[51] Int. Cl.[5] ..... G03G 15/09

[52] U.S. Cl. ..... 355/251; 118/657; 355/253

[58] Field of Search ..... 355/245, 251, 253, 326, 355/327, 246; 118/653, 657, 658

[56] References Cited

U.S. PATENT DOCUMENTS

| | | | |
|---|---|---|---|
| 3,572,288 | 3/1971 | Turner . | |
| 3,914,043 | 10/1975 | McVeigh . | |
| 4,461,562 | 7/1984 | Goldfinch | 355/251 |
| 4,579,443 | 4/1986 | Abuyama et al. | 355/326 X |
| 4,755,850 | 7/1988 | Suzuki et al. | 355/246 X |
| 4,804,995 | 2/1989 | Osawa et al. | 118/657 X |
| 4,862,216 | 8/1989 | Higashi et al. | 355/245 X |
| 4,866,486 | 9/1989 | Higashio et al. | 365/251 X |
| 4,885,611 | 12/1990 | Higashio et al. | 355/245 |
| 4,891,671 | 2/1990 | Iwamasa | 355/245 |

FOREIGN PATENT DOCUMENTS 62-108063 9/1986 Japan .

61-203474 9/1986 Japan .

*Primary Examiner*—A. T. Grimley
*Assistant Examiner*—William J. Royer
*Attorney, Agent, or Firm*—Burns, Doane, Swecker & Mathis

[57] ABSTRACT

An image forming apparatus arranged to develop an electrostatic latent image formed on an electrostatic latent image holding member, and including a developing sleeve rotatably provided to confront the electrostatic latent image holding member, a sleeve driving device for rotating the developing sleeve, a magnet roller provided within the developing sleeve and having a plurality of magnetic poles, a magnet roller driving device for rotating the magnet roller through a predetermined angle, with the magnet roller driving device being arranged to rotate the magnet roller between a first state where its magnetic pole confronts the electrostatic latent image holding member and a second state where an intermediate portion between neighboring magnetic poles confronts the electrostatic latent image holding member, and a control unit for controlling the sleeve driving device and the magnet roller driving device in such a manner as to rotate the magnetic poles of the magnet roller from the first state to the second state after stopping rotation of the developing sleeve when the developing function is to be completed. A bias voltage is applied to the developing sleeve such that the amount of bias voltage applied to the developing sleeve is change from a first value to a second value upon stopping rotation of the developing sleeve or following rotation of the magnet roller, the first value being closer to zero than the second value.

9 Claims, 9 Drawing Sheets

IMAGE FORMING APPARATUS CAPABLE OF PREVENTING SIMULTANEOUS ROTATION OF THE MAGNET ROLL AND THE DEVELOPING SLEEVE

BACKGROUND OF THE INVENTION

The present invention generally relates to an image forming arrangement and more particularly, to a copying apparatus capable of effecting a simultaneous multicolor copying control for obtaining images in a plurality of colors by causing a plurality of developing units to function through change-over during on copying operation.

Conventionally, there has been proposed a copying apparatus of the above described type, for example, in U.S. patent application No. 148,423 assigned to the same assignee as in the present invention.

In the above known copying apparatus, two magnetic brush type developing units are provided at side portions of a photosensitive or photoreceptor drum which functions as an electrostatic latent image holding member, with developing materials or developers in different colors being accommodated in the respective developing units.

Each of the above developing units is provided with a developing sleeve confronting said photoreceptor drum, and a magnet roller accommodated within said developing sleeve is arranged to be rotatable by a predetermined angle, so that magnetic poles provided on an outer periphery of said magnet roller may be moved or changed over between a developing position confronting said photoreceptor drum and another developing position where an intermediate portion between neighboring magnetic poles faces the photoreceptor drum.

In the conventional copying apparatus having the construction as described above, a portion from a leading edge of the original document to a first boundary region as designated is developed, for example in black through employment of the first developing unit, and successively, another portion from said first boundary region to a second boundary region is developed, for example in color by the use of the second developing unit, and a multi-color image can be obtained by repeating the similar operations as above thereafter.

However, in the above copying apparatus, for the development at the boundary region, turning off of the developing sleeve and change-over of the magnet roller are effected simultaneously, and therefore, inertia force due to speed retardation and stopping of the developing sleeve, and transporting force of the developer following movement of the magnet roller are applied to the developer at the same time, whereby the developer on the developing sleeve is temporarily increased in density, with the toner scattering over the electrostatic latent image holding member, thus resulting in such a problem as reduction of image quality due to noises appearing on the image.

SUMMARY OF THE INVENTION

Accordingly, an essential object of the present invention is to provide an image forming apparatus which is capable of preventing scattering of toner during starting of a developing unit by arranging to start rotation of a developing sleeve after having displaced magnetic poles of a magnet roller at starting of the developing function, with a bias voltage impression being held in a non-developing state during the period from the displacement of the magnetic poles to the starting rotation of the developing sleeve.

Another object of the present invention is to provide an image forming apparatus which is capable of preventing scattering of toner during stopping of the developing unit by arranging to displace the magnetic poles after having stopped rotation of the developing sleeve at stopping of the developing function, with the bias voltage impression being held in a non-developing state during the period from the stopping rotation of the developing sleeve to the displacement of the magnetic poles.

A further object of the present invention is to provide an image forming apparatus which is capable of preventing scattering and color mixture of toner during starting and stopping of the developing unit by arranging to displace the magnetic poles after having stopped rotation of the developing sleeve and also, having changed over the bias voltage impression to the non-developing state during stopping of the developing function, with the bias voltage impression being changed over to the developing state simultaneously with the starting of rotation of the developing sleeve after having displaced the magnetic poles at starting of the developing function.

A still further object of the present invention is to provide an image forming apparatus which is capable of preventing scattering of toner during starting and stopping of the developing unit, and also preventing deterioration in the image quality by arranging to start rotation of the developing sleeve after having displaced the magnetic poles and changed over the bias voltage impression to the developing state at starting of the developing function, with the bias voltage impression being changed over to the non-developing state simultaneously with the displacement of the magnetic poles after having stopped rotation of the developing sleeve when the developing function is to be stopped.

In accomplishing these and other objects, according to one aspect of the present invention, there is provided an image forming apparatus arranged to develop an electrostatic latent image formed on an electrostatic latent image holding member, and including .a developing sleeve rotatably provided to confront the electrostatic latent image holding member, a sleeve driving means for rotating said developing sleeve, a magnet roller provided within said developing sleeve and having a plurality of magnetic poles, a magnet roller driving means for rotating said magnet roller through a predetermined angle, with the magnet roller driving means being arranged to rotate said magnet roller between a first state where a magnetic pole thereof confronts the electrostatic latent image holding member and a second state where an intermediate portion between neighboring magnetic poles confronts said electrostatic latent image holding member, and a control means for controlling said sleeve driving means and said magnet roller driving means in such a manner as to rotate the magnetic poles of said magnet roller from the first state to the second state after stopping rotation of said developing sleeve when the developing function is to be completed.

In another aspect of the present invention, the image forming apparatus includes a developing sleeve rotatably provided to confront the electrostatic latent image holding member, a sleeve driving means for rotating said developing sleeve, a magnet roller provided within said developing sleeve and having a plurality of magnetic poles, a magnet roller driving means for rotating said magnet roller through a predetermined angle, with the magnet roller driving means being arranged to rotate said magnet roller between a first state where a magnetic pole thereof confronts the electrostatic latent image holding member and a second state where an intermediate portion between neighboring magnetic poles confronts said electrostatic latent image holding member, means for applying a bias voltage to said developing sleeve, and control means for controlling said sleeve driving means and said magnet roller driving means so as to start rotation of the developing sleeve after having rotated the magnetic poles of said magnet roller from said second state to said first state when the developing function is to be started, and also for controlling said bias voltage applying means so as to further lower the bias voltage being applied to said developing sleeve upon starting rotation of said developing sleeve.

In a further aspect of the present invention, the image forming apparatus includes a developing sleeve rotatably provided to confront the electrostatic latent image holding member, a sleeve driving means for rotating said developing sleeve, a magnet roller provided within said developing sleeve and having a plurality of magnetic poles, a magnet roller driving means for rotating said magnet roller through a predetermined angle, with the magnet roller driving means being arranged to rotate said magnet roller between a first state where a magnetic pole thereof con fronts the electrostatic latent image holding member and a second state where an intermediate portion between neighboring magnetic poles confronts said electrostatic latent image holding member, means for applying a bias voltage to said developing sleeve, and control means for controlling said sleeve driving means and said magnet roller driving means so as to start rotation of the developing sleeve after having rotated the magnetic poles of said magnet roller from said second state to said first state when the developing function is to be started, and also for controlling said bias voltage applying means so as to further lower the bias voltage being applied to said developing sleeve during rotation of said magnet roller.

It is to be noted that the respective constructions of the present invention as referred to above are commonly arranged to effect the displacement of the magnetic poles in the stopped state of the developing sleeve in order to solve the common problem that, if the displacement of the magnetic poles of the magnet roller is effected in the state where the developing sleeve is still rotating, the undesirable scattering of toner takes place due to a large centrifugal force (i.e. transport force by the rotation of the developing sleeve + transport force by the displacement of the magnetic poles) temporarily applied to the developer on the developing sleeve.

It should also be noted that, in the constructions for another and further aspects of the present invention referred to above, the arrangement for the change-over of the developing bias is further added to the items in the construction for the one aspect for the improvement of the image quality a edge portions of the image region.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
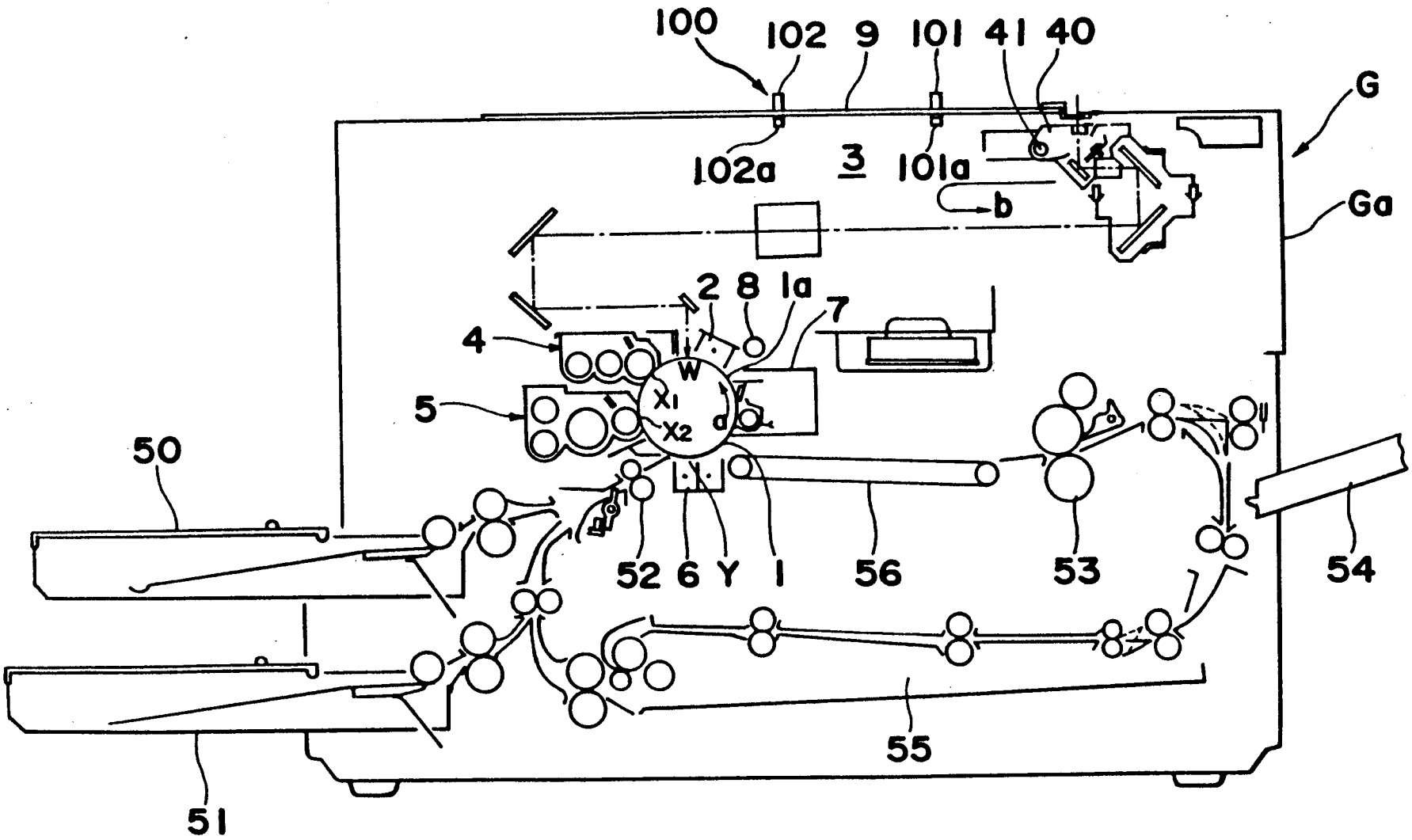
FIG. 1 is a schematic side sectional view showing general construction of a copying apparatus provided with a simultaneous multi-color copying function, to which the present invention may be applied.

Before the description of the present invention proceeds, it is to be noted that like parts are designated by like reference numerals throughout the accompanying drawings.

FIRST EMBODIMENT

Referring now to the drawings, there is shown in FIG. 1 an electrophotographic copying apparatus provided with a simultaneous multi-color copying function, to which the present invention may be applied, and the general construction of which will be described hereinbelow together with the standard copying operation for reproducing an image of an original document as it is.

In FIG. 1, the multi-color copying apparatus G generally includes a photosensitive or photoreceptor drum 1 having a photosensitive surface la on its outer periphery and rotatably disposed generally at a central portion of an apparatus housing Ga for rotation in a direction indicated by an arrow a, and various processing stations such as a corona charger 2, a first developing unit 4 and a second developing unit 5, a transfer charger 6, a cleaning device 7 and an eraser lamp 8, etc. sequentially disposed around the photoreceptor drum 1 as shown.

In the state where the photoreceptor drum 1 is rotating in the direction of the arrow a, the photosensitive surface 1*a* of the photoreceptor drum 1 is charged with a predetermined amount of electrical charge through discharge by the corona charger 2.

Subsequently, a scanner 40 of an optical system 3 having an exposure lamp 41 and movably disposed below and adjacent to a transparent original document platform 9 of a glass material or the like provided at the upper portion of the housing Ga, projects light onto an original document (not shown) placed on said platform 9, while performing the scanning function in the direction of an arrow b, and the light reflected from the original document is projected onto the photosensitive surface 1*a* of the photoreceptor drum 1 via reflecting mirrors and a lens assembly through an exposure point W, and thus, an electrostatic latent image corresponding to the image of the original document is formed on said surface 1*a*.

The electrostatic latent image thus formed is developed into a visible toner image by toner at a developing region X1 or X2 corresponding in position to the first developing unit 4 or second developing unit 5 as the photoreceptor drum 1 rotates, thereby forming the toner image which is the reproduction of the original document image.

Meanwhile, the copy paper sheet is supplied selectively from a paper feeding section 50 or 51 provided at the lower left portion of the apparatus housing Ga in FIG. 1, and is transported by a set of timing rollers 52, to a portion confronting the transfer charger 6 (i.e., a transfer region Y) in timed relation with respect to the toner image formed on the photoreceptor drum 1. After having been transferred with the toner image thereon, the copy paper sheet is transported into between a pair of fixing rollers 53 through a transport belt 56 movably supported by rollers so that the toner image is fixed thereon by heat-fusing of toner, and is then discharged onto a discharge tray 54.

However, if a duplex or opposite side copying mode has been selected, the copy paper sheet is transported into a duplex device 55 so as to be turned over in its front and reverse faces thereat, and then, again transported to the transfer region Y, while at the optical system 3 and around the photoreceptor drum 1, a second copying function is effected in the similar manner as before so as to form the image on the reverse side of the copy paper sheet this time.

The toner remaining on the photosensitive surface 1*a* of the photoreceptor drum 1 is scraped off therefrom by the cleaning device 7, and further, residual charge thereon is also erased through irradiation of light by the eraser lamp 8 in preparation for subsequent development.

In addition to the standard copying as described above for a single color copying which is effected through selection of a desired developing unit, the copying apparatus G is also capable of effecting a function to obtain a two-colored image by causing two developing units 4 and 5 to function through change-over in one copying operation, based on one scanning function by the scanner 40 (referred to as a simultaneous multi-color copying), and for this purpose, an image editing mechanism 100 is provided, with particular mechanisms being provided in the developing units 4 and 5 respectively as described later.

Figure 2:
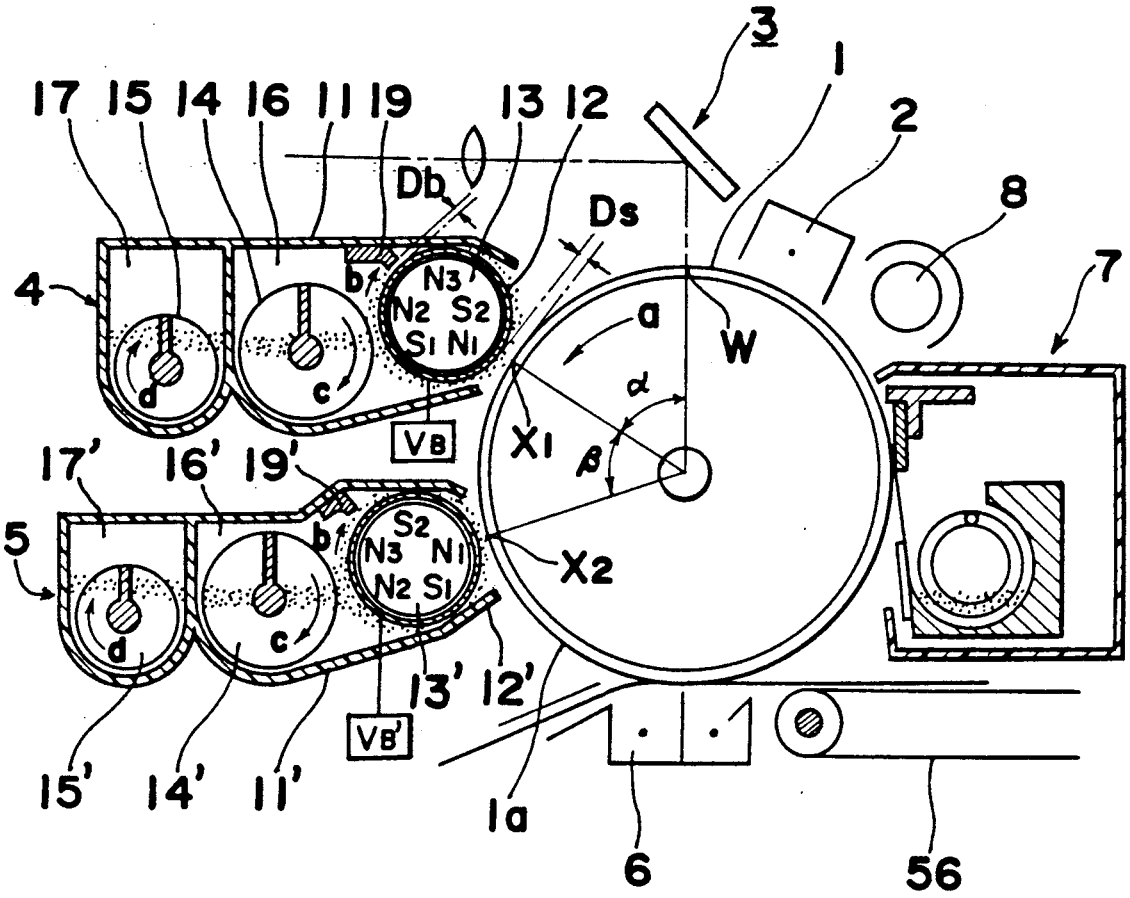
FIG. 2 is a fragmentary side sectional view showing on an enlarged scale, a photoreceptor drum, developing units and neighboring portions thereof, as employed in the copying apparatus of FIG. 1.

FIG. 2 shows surrounding portions of the photoreceptor drum 1, especially, the first and second developing units on an enlarged scale.

As is seen from FIG. 2, each of the developing units 4 and 5 having construction generally equal to each other includes a developing tank 11 open at its one edge adjacent to the photosensitive surface 1*a* of the photoreceptor drum 1, and a developing sleeve 12, a supply roller 14 and a screw 15 rotatably provided within said developing tank 11 in that order sequentially from the side of the photoreceptor drum 1. In the first developing unit 4, a developer composed of magnetic carrier and insulative color toner is accommodated, while in the second developing unit 5, another developer composed of magnetic carrier and insulative black toner normally used is contained.

The developing sleeve 12 made of non-magnetic electrically conductive material formed into a cylindrical shape (24.5 mm in diameter) is formed with very small concave and convex portions or undulations on its outer peripheral surface by sand blast processing, and confronts the photosensitive surface la of the photoreceptor drum 1 at the developing region X1 or X2 through a developing gap Ds (=0.6 mm), with rotational angles from the exposure point W to the developing regions X1 and X2 being respectively set as ($\alpha$) and ($\alpha+\beta$), wherein $\alpha$ is set at 56° and $\beta$ at 52°.

Moreover, the developing sleeve 12 is impressed with a developing bias $V_B$, which is adapted to be changed over between $V_{B1}=150V$ and $V_{B2}=300V$.

Meanwhile, at the back face side of the developing sleeve 12 with respect to the developing region X1, a magnetic brush bristle height restricting plate 19 is provided at an upper inner portion of the developing tank 11 so as to confront the surface of said developing sleeve 12 through a magnetic brush bristle height restricting gap Db (=0.4 mm).

Within the developing sleeve 12, there is disposed a magnet roller 13 having a plurality of magnets extending in the axial direction, and magnetic forces of magnetic poles N1, N2 and N3, and S1 and S2 located at outer peripheral faces of such magnets are respectively set as N1=1000G, N2 and N3=500G, and S1 and S2=800G (G is an abbreviation of a unit of gauss).

Figure 4:
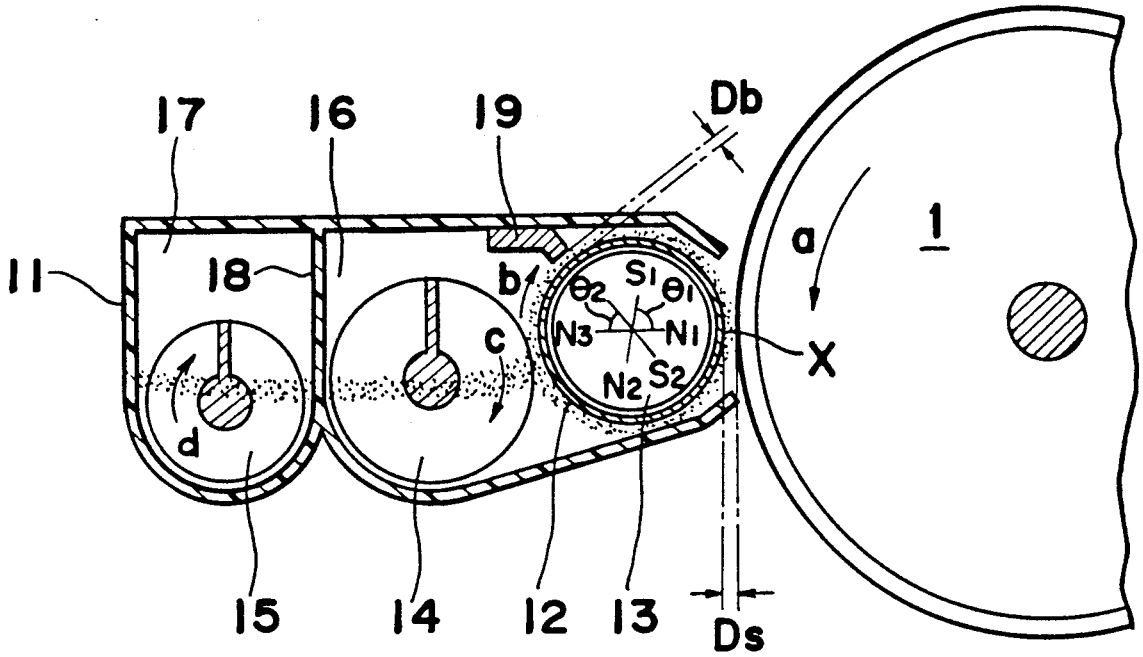
FIG. 4 is a side sectional view showing positions of magnetic poles for a magnet roller in the developing unit, where a development can be carried out.

As shown in FIG. 4, the center of the magnetic pole N1 is disposed at a point deviated by an angle $\theta 1$ (80°) clockwise from the center of the magnetic pole S1. The center of the magnetic pole N3 is disposed at a point deviated by an angle $\theta 2$ (40°) counterclockwise from the portion of the developing sleeve 12, which confronts the magnetic brush bristle height restricting plate 19 when the magnetic pole N1 confronts the photoreceptor drum 1.

Figure 3:
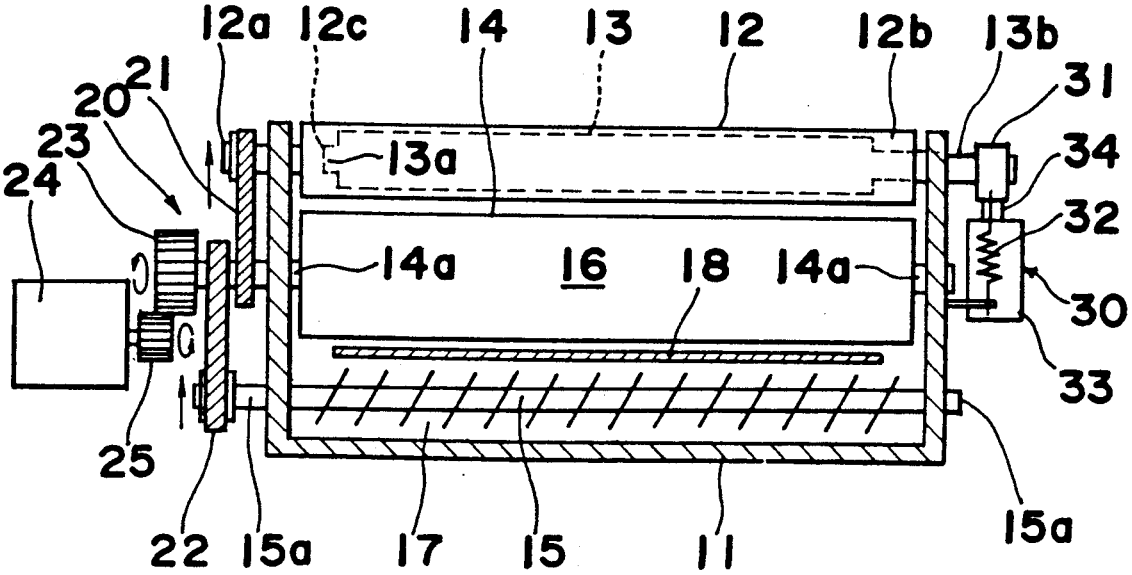
FIG. 3 is a transverse cross sectional view of a first developing unit employed in the arrangement of FIG. 2.

As shown in FIG. 3, one end portion 13*a* of the shaft of the magnet roller 13 is supported at a bearing recess 12*c* provided within the developing sleeve 12, and the other end portion 13*b* thereof is supported by one of the side walls of the developing tank 11. The magnet roller 13 can be rotated through a predetermined angle ($\theta 1=40°$) by a moving or change-over means 30 described later.

A shaft bearing portion 12*b* of the developing sleeve 12 shown in FIG. 3 is supported by the shaft 13*b* of the magnet roller 13, and the shaft portion 12*a* at the opposite side to the shaft bearing portion 12*b* is supported by one of the side walls of the developing tank 11. Thus, the developing sleeve 12 can be rotated by a drive means 20.

The supply roller 14 and the screw 15 are disposed on transport passages 16 and 17, respectively partitioned by a partition wall 18, and a shaft 14*a* of the roller 14 and a shaft 15*a* of the screw 15 are respectively supported by corresponding side walls of the developing tank 11, thereby the supply roller 14 and the screw 15 being rotated by the drive means 20.

The transport passage 16 is communicated with the transport passage 17 in the vicinity of both of the side walls of the developing tank 11 as shown in FIG. 3.

The drive means 20 for driving the developing units 4 and 5, the supply roller 14, and the screw 15 will be described hereinafter.

As shown in FIG. 3, an endless belt 21 is passed around the shaft 12*a* of the developing sleeve 12 and the shaft 14*a* of the supply roller 14. Another endless belt 22 is also directed around the shaft 14*a* of the supply roller 14 and the shaft 15*a* of the screw 15.

A gear 23 is mounted on one end of the shaft 14*a* of the supply roller 14. The gear 23 is engaged with a drive gear 25 of a motor 24.

According to this construction, when the drive gear 25 is rotated by the motor 24 in the direction shown by an arrow of a solid line, the gear 23 is rotated, and the belts 21 and 22 are moved, respectively in the directions as shown by the arrows of solid lines, which causes the developing sleeve 12, the supply roller 14, and the screw 15 to rotate in the directions shown by arrows b, c, and d in FIG. 2. The rotating speed of the developing sleeve 12 is 240 r.p.m.

Figure 5:
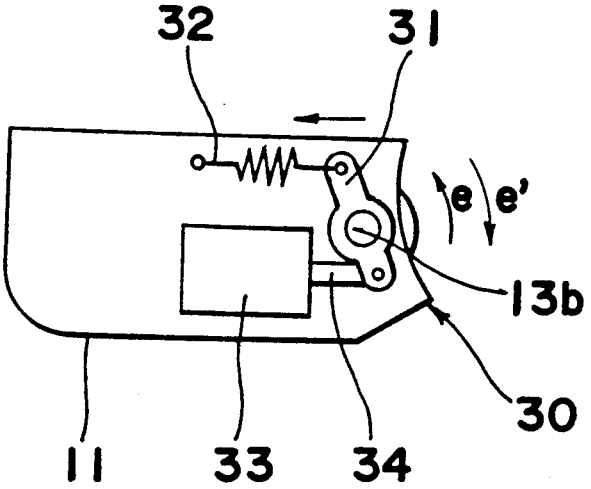
FIG. 5 is a side elevational view for explaining drive conditions of a change-over means for a magnet roller.
Figure 7:
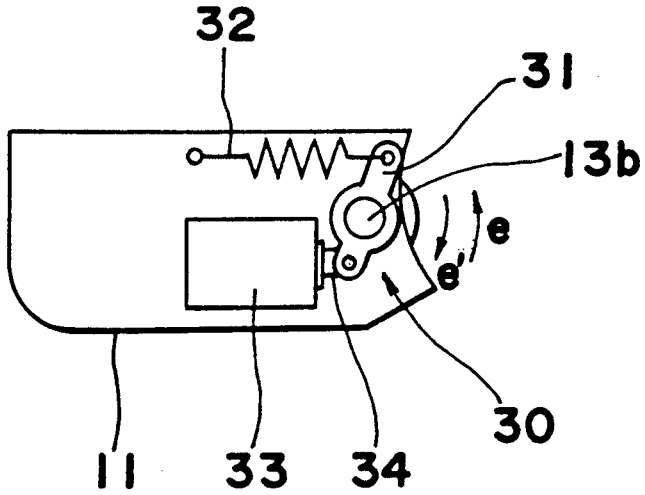
FIG. 7 is a side elevational view of the change-over means when not in operation.

The moving or change-over means 30 for driving the magnet roller 13 comprises a lever 31, a spring 32, and a solenoid 33 as shown in FIGS. 5 and 7. The lever 31 is fixed to one end of the shaft 13*b* of the roller 13. One end of the lever 31 is fixed to one end of the spring 32 secured to the developing tank 11. The lever 31 is always urged by the spring 32 in the direction shown by an arrow e. A plunger 34 for the solenoid 33 is fixed to the other end of the lever 31. When the solenoid 33 is driven, the lever 31 is rotated in the direction shown by an arrow e' against the urging force of the spring 32.

When the solenoid 33 is not driven, namely, when the lever 31 is positioned as shown in FIG. 5, the magnetic pole N1 of the magnet roller 13 confronts the photoreceptor drum 1 and the magnetic pole N3 is at the position deviated by an angle $\theta 2$ (40°) counterclockwise from the portion, of the developing sleeve 12, which confronts the magnetic brush bristle height restricting plate 19 as shown in FIG. 4.

Figure 6:
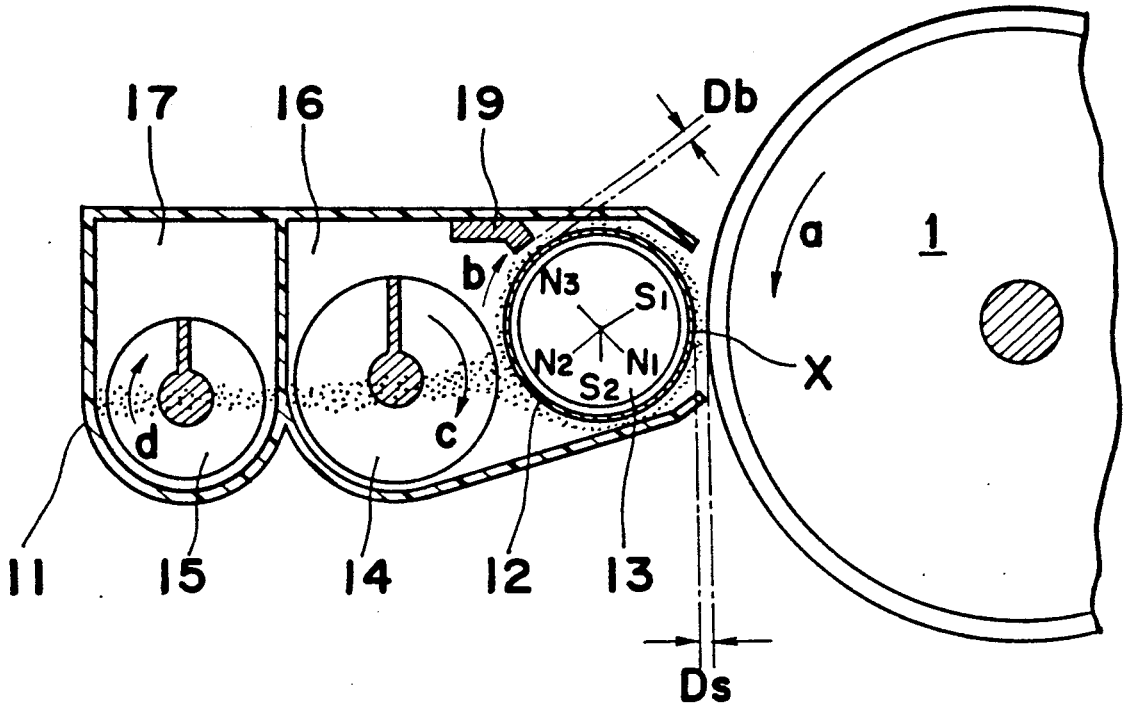
FIG. 6 is a side sectional view showing positions of the magnetic poles for the magnet roller which has completed a development.

When the solenoid 33 is driven, namely, when the lever 31 is positioned as shown in FIG. 7, the magnetic pole N3 confronts the restricting plate 19 and the intermediate point between the magnetic poles N1 and S1 confronts the photoreceptor drum 1 as shown in FIG. 6.

The image editing mechanism 100 will be described hereinafter.

Figure 8:
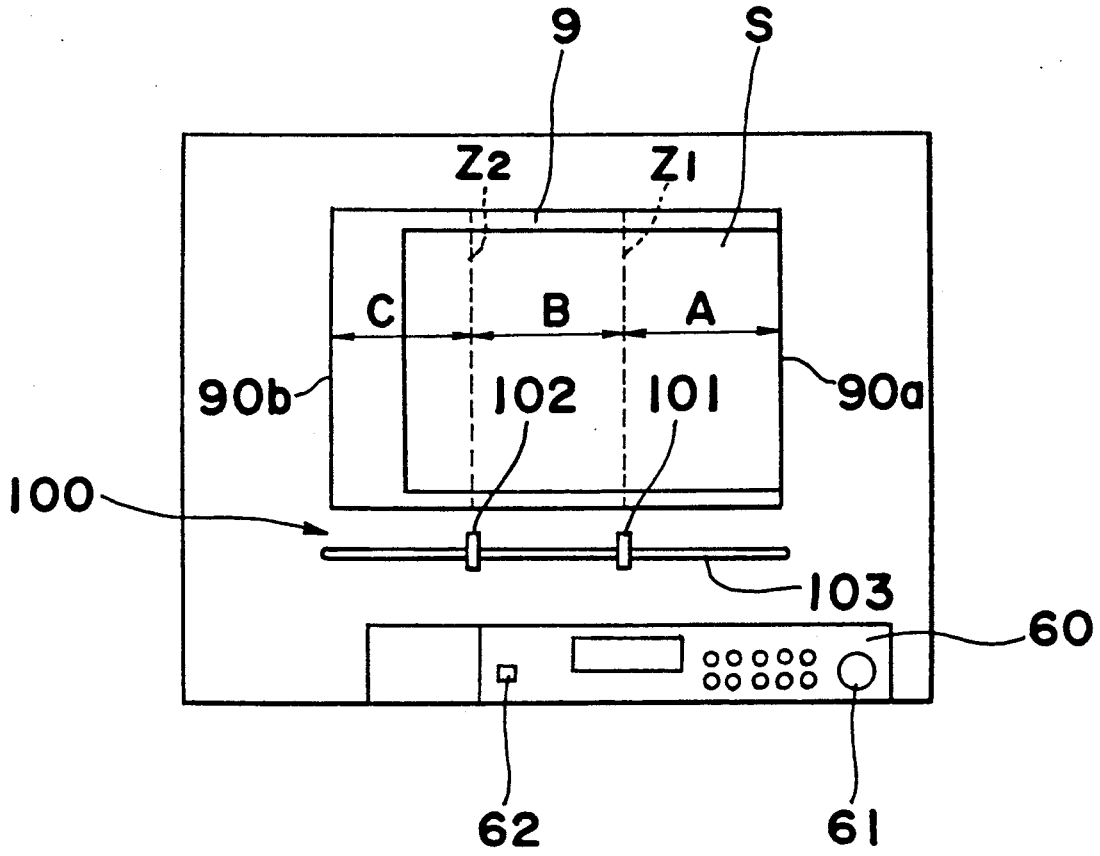
FIG. 8 is a top plan view showing an editing mechanism.
Figure 9:
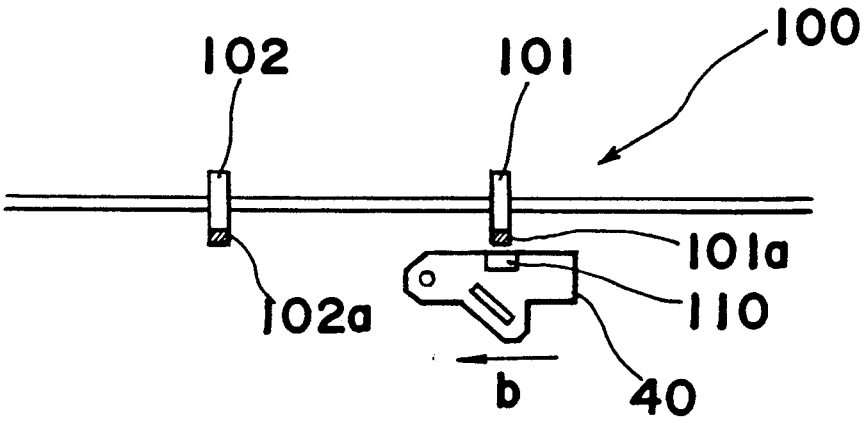
FIG. 9 is a side elevational view showing relationship between first and second levers of the editing mechanism and a reed switch of a scanner.

First, a region specifying means for the mechanism 100 is described. Referring to FIGS. 8 and 9, first and second levers 101 and 102 of the image editing mechanism 100 specify regions to be copied (hereinafter referred to as regions), by dividing the surface of the original document platform 9 in the direction (shown by an arrow b) in which the scanner 40 moves, and also specify a color to be reproduced. The levers 101 and 102 are mounted on the side portion of the platform 9 so as to be slidable along a guide groove 103 formed in the direction in which the scanner 40 moves. Magnets 101*a* and 102*a* are respectively provided at the lower ends of the levers 101 and 102, which are positioned in the housing of the copying apparatus.

When the positions of the levers 101 and 102 are set as shown in FIG. 8, regions are specified as follows:

The area between one edge 90*a* of the original document platform 9 and the first lever 101 is specified as a region A. The area between the first lever 101 and the second lever 102 is specified as a region B. The area between the second lever 102 and the other edge 90*b* of the original document platform 9 is specified as a region C. The regions A and C are specified to be reproduced in black and white, and the region B in color.

Figure 10:
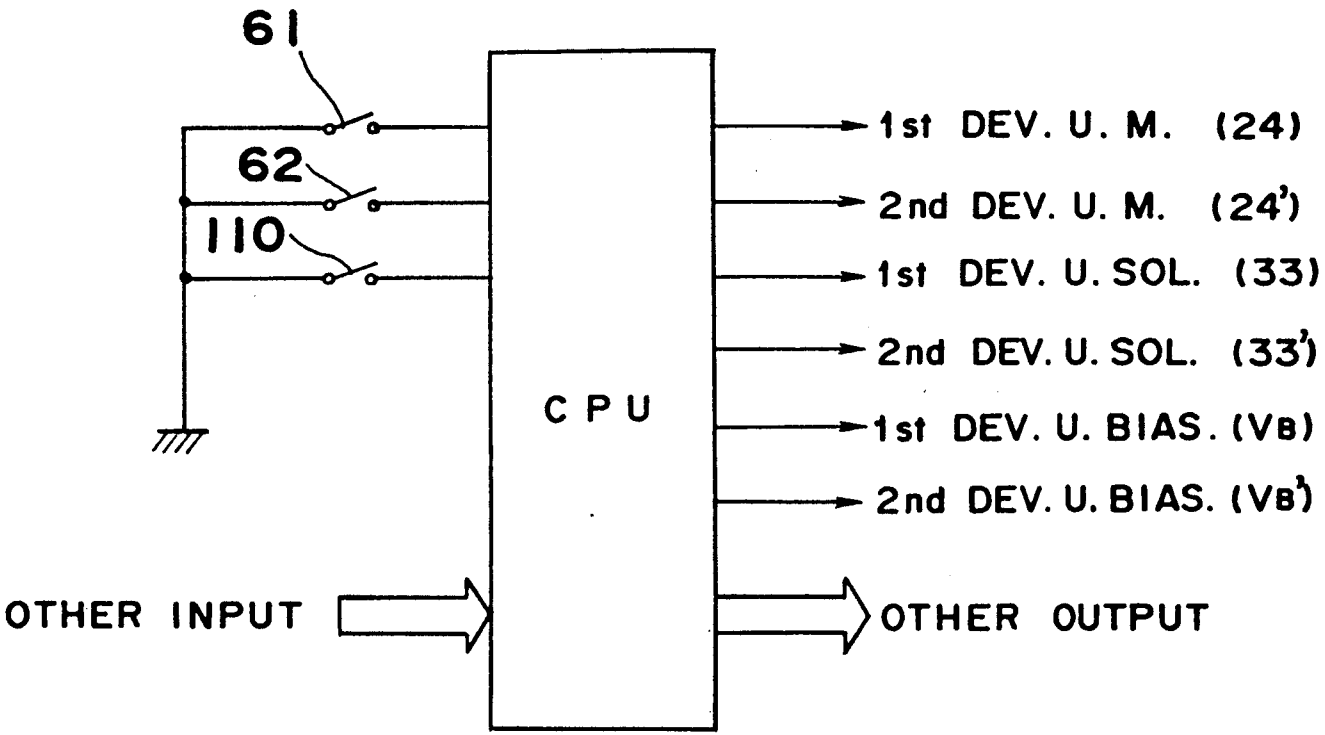
FIG. 10 is an electrical diagram showing a general construction of a control circuit for the copying apparatus of FIG. 1.

When a reed switch 110 mounted on the scanner 40 of the optical system 3 detects magnets 101*a* and 102*a* during a scanning operation, the reed switch outputs a detecting signal to a control unit CPU shown in FIG. 10. In response to the signal the drive means drives either the first developing unit 4 or the second developing unit 5 so as to effect developing.

In FIG. 8, there is also shown a control panel 60 provided with a print switch 61 and a simultaneous multi-color copy switch 62, which are also connected to the central processing unit CPU.

Figure 11:
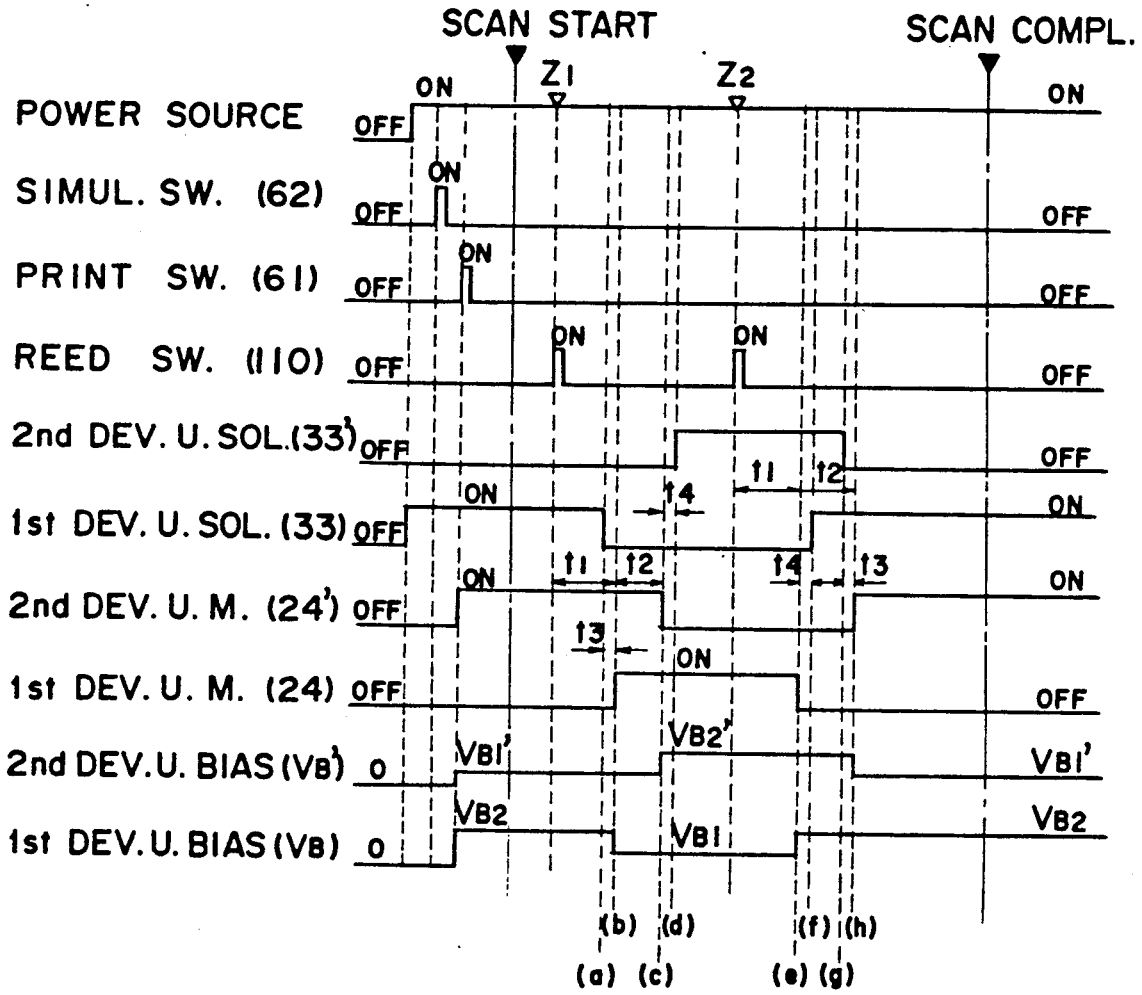
FIG. 11 is a time chart for explaining control of the copying apparatus according to a first embodiment of he present invention.

Subsequently, control function of the control unit CPU will be described with respect to the case for effecting the simultaneous multi-color copying by referring to FIGS. 10 and 11. It is to be noted that the prime mark is given to the reference numerals of the components of the second developing unit 5.

When the main switch (not shown) of the copying apparatus G is turned on, the solenoid 33 is energized, and as shown in FIG. 6, the intermediate portion between the magnetic poles N1 and S1 of the first developing unit 4 confronts the photoreceptor drum 1, while in the second developing unit 5, the solenoid 33' is in the off state, and as shown in FIG. 4, the magnetic pole N1 confronts the photoreceptor drum 1.

When the print key 61 (FIG. 8) is turned on in this state, the second developing unit 5 housing a black toner is automatically driven, thereby the standard copying operation being carried out. When the simultaneous multi-color copy switch 62 is turned on in this state, the simultaneous multi-color copying mode is set in a state ready to be effected. It is to be noted, however, that even if the simultaneous multi-color copy switch 62 is depressed during the copying operation, it does not function at all.

When the simultaneous multi-color switch 62 is turning on during standing-by of the copying apparatus, the copy mode is switched from the standard copy mode, to the simultaneous multi-color copying mode.

In this state, the first and second levers 101 and 102 are slid along the slide groove 103 so as to specify the image of the regions A and C to be reproduced in monochrome and the image of the region B to be reproduced in color as shown in FIG. 8.

The levers 101 and 102 are arranged to function only when the simultaneous multi-color copying mode is specified, and thus, can not function in a state other than that. When the print key 61 is turned on in the state as described above with an original document S placed on the original document platform 9, as shown in FIG. 8, the developing bias $V_B$ and $V_b'$ and for the developing units 4 and 5 are respectively set at and $V_{B2}=300V$ and $V_{B1}'=150V$ from 0 volt respectively, and the motor 24' of the second developing unit 5 is started by the drive control means, whereby the developing sleeve 12', supply roller 14', and screw 15' are rotated in the directions b, c, and d shown by arrows.

By the operations of these components of the second developing unit 5, the developer containing a black toner and housed in a developing tank 11' is mixed and stirred through rotation of the supply roller 14' and the screw 15', while the developer is being transported along the transport passages 16' and 17'. During the transportation, part of the developer is supplied to the surface of the developing sleeve 12' by the supply roller 14' so as to form a magnetic brush on the developing sleeve 12'.

The developer in the form of a magnetic brush is fed to the developing region X2 by the rotation of the developing sleeve 12', and passes through the bristle height restricting gap Db with a specified amount of developer being regulated or cut off by the magnetic brush bristle height regulating plate 19'.

Thereafter, the developer is sequentially transported to the developing region X2 so as to contact the surface 1*a* of the photoreceptor drum 1 at a predetermined width, and thus, an electrostatic latent image formed on the surface 1*a* of the photoreceptor drum 1 at the region X2 is, set in a state to be developed by the developer.

When the print key 61 is turned on, the scanner 40 starts scanning the image of the original document S in the direction shown by the arrow b. The surface of the photoreceptor drum 1 is irradiated by the light reflected from the original document S placed on the original document placing platform 9 through the exposure point W, thus an electrostatic latent image being formed. Thereafter, the second developing unit 5 start developing the electrostatic latent image.

Then, when the magnet 101*a* of the first lever 101 is detected by the reed switch 110 mounted on the scanner 40, a signal is inputted by the reed switch 110 to the control unit CPU.

At this time, the electrostatic latent image corresponding to a boundary Z1, between the region A and the region B, at which the copy mode is changed from the first copy mode to the second copy mode, namely, from black to colors (red or yellow) is positioned at the exposure point W on the photoreceptor drum 1. During the time period (t1=0.22 sec) in which the boundary Z1 moves from the exposure point W to the developing region X1 of the first developing unit 4, only the second developing unit 5 is successively operated.

After passing a time period t1-t3 (t3=0.08 sec) from the turning on of the reed switch 110, upon deenergization of the first developing unit solenoid 33, the magnet roller 13 of the first developing unit 4 rotates counterclockwise and is set at the state as shown in FIG. 4.

Subsequently after passing the time period t3 from the off function of the solenoid 33, when the boundary portion Z1 of the electrostatic latent image has reached the developing region X1, the developing motor 24 is turned on, and the first developing unit 4 is set in the state shown in FIGS. 4 and 5 in the similar manner as in the second developing unit 5, and thus, the developing sleeve 12, the supply roller 14, the screw 15 are rotated respectively in the directions of arrows b, c, and d, whereby the magnetic brush is formed on the surface of the developing sleeve 12 to establish a state in which the electrostatic latent image formed on the surface 1*a* of the photoreceptor drum 1 may be developed, while the developing bias voltage $V_B$ is reduced from $V_{B1}=300V$ to $V_{B2}=150V$. Thus, supply of the color toner to the electrostatic latent image corresponding to the region B is started.

The reason why the start timing of the motor 24 is delayed by the time period t3 from the "off" timing of the solenoid 33 is as follows.

Specifically, upon rotation of the magnet roller 13 in the counterclockwise direction based on the turning off of the solenoid 33, the developer on the developing sleeve 12 is subjected to a transport force in the clockwise direction as indicated by the arrow b following movement of the magnetic poles thereof. Moreover, the developer is also subjected to a transport force in the direction of the arrow b also by the rotation of the developing sleeve 12.

Accordingly, if the on timing of the developing sleeve 12 coincides with the off timing of the solenoid 13, or when the solenoid 13 is turned off during rotation of the developing sleeve 12, the developer is temporarily subjected to a very large centrifugal force so as to be scattered towards the photoreceptor drum 1.

Therefore, it is so arranged to prevent the developer from scattering through reduction of the centrifugal force acting on the developer, by moving the magnetic poles through rotation of the magnet roller 13 first, and then, rotating the developing sleeve 12.

After passing the time t2 (t2=0.2 sec) from the start of the first developing motor 24, namely, after passing the period t2 in which the boundary Z1 of the electrostatic latent image has moved from the developing region X1 to the developing region X2 of the second developing unit 5, the motor 24' of the second developing unit 5 is turned off, with the developing bias voltage $V_B'$ being changed over from to $V_{B1}'=150V$ to $V_{B2}'=300V$, and the solenoid 33' for the second developing unit 5 is turned on after a time period t4 (t4=0.08 sec) from the off timing of the motor 24' by the drive control means, whereby the second developing unit 5 is set to the state as shown in FIGS. 6 and 7, and the intermediate portion between the magnetic poles N1 and S1 confronts the photoreceptor drum 1, and the developing sleeve 12, the supply roller 14, and the screw 15 stop rotations. Thus, the developing operation of the image of the region A by a black toner is completed.

When the scanner 40 further moves and reaches the position where the second lever 102 is located, namely, when the scanner 40 is at the boundary Z2 between the regions B and C, the reed switch 110 is turned on upon detection of the magnet 102*a* and a signal is inputted to the control unit CPU. At this time, the electrostatic latent image corresponding to the boundary Z2 is positioned at the exposure point W.

At the time t1 after the reed switch 110 has been turned on, namely, when the electrostatic latent image of the boundary Z2 has arrived at the developing region X1, the motor 24 of the first developing unit 4 is turned off with the developing bias voltage $V_B$ being changed over from $V_{B1}=150V$ to $V_{B2}=300V$ and the solenoid 33 for the first developing unit 4 is turned on after the time period t4. Thus, the developing operation of the image of the region B in color is completed.

Further, after a time period t2-t3 from the on function of the solenoid 33, the solenoid 33' for the second developing unit 5 is turned off, and after a time period t3 therefrom, i.e., upon arrival of the electrostatic latent image located at the developing region X1 and corresponding to the boundary portion Z2, at the developing region X2 for the second developing unit, the motor 24' for the second developing unit 5 is started, while the developing bias voltage $V_B'$ is changed over from $V_{B2}'=300V$ to $V_{B1}=150V$.

As described above, since the start timing of the motor 24' is delayed by the time period t3 from the off timing of the solenoid 33' also with respect to the region C in the similar manner as in the developing starting time for the region B, there is no possibility that the developing material scatters from the developing sleeve 12' towards the photoreceptor drum 1.

Thus, the developing function of the second developing unit 5 is maintained up to the termination of the scanning, thereby to complete the development with respect to the region C.

By the foregoing operations, the two-color composite copy may be obtained in which the developing color is changed from black to color, and further, to black, during the period form starting of the scanning to the completion thereof.

Figure 12:
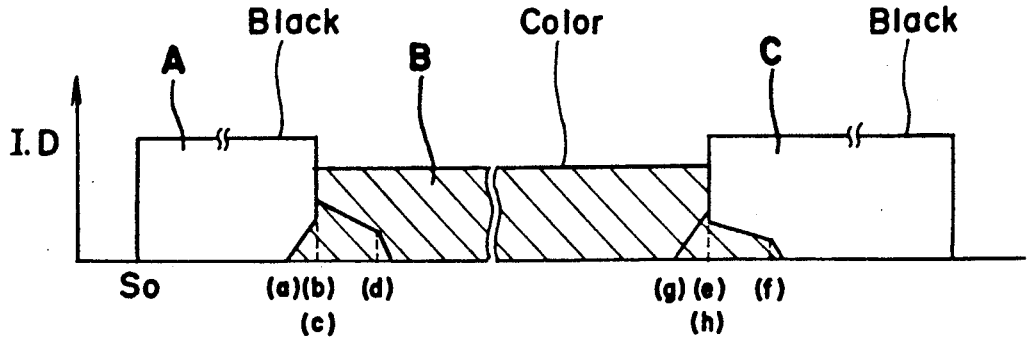
FIG. 12 is a diagram showing the state of variation in the image density of produced images.

In FIG. 12, there is shown a diagram showing an image density of the two-color composite copy in the direction of scanning, in which a symbol So represents a point corresponding to the leading edge of the original document S and coinciding with the leading edge 90a of the original document platform 9. Meanwhile, symbols (a) to (h) denote time points as follows also indicated in a time chart of FIG. 11.

(a) Off time point of the solenoid 33.
(b) On time point of the motor 24, and change-over time point of the developing bias voltage $V_B$ from $V_{B2}$ to $V_{B1}$.
(c) Off time point of the motor 24', and change-over time point of the developing bias voltage $V_B'$ from $V_{B1}'$ to $V_{B2}'$.
(d) On time point of the solenoid 33'.
(e) Off time point of the motor 24, and change-over time point of the developing bias voltage $V_b$ from $V_{B1}$ to $V_{B2}$.
(f) On time point of the solenoid 33.
(g) Off time point of the solenoid 33'.
(h) On time point of the motor 24', and change-over time point of the developing bias voltage $V_b'$ from $V_{B2}'$ to $V_{B1}'$.

As shown in FIG. 12, the image in the region A as developed by the black toner is reproduced at a constant density from the image leading edge So to the time point (c) at which the developing motor 24' stops. Upon stopping of the developing motor 24' at the time point (c), when the developing bias voltage $V_B'$ is changed over from $V_{B1}'$ to $V_{B2}'$, the image density is rapidly lowered, with a subsequent gradual lowering, and immediately after turning off of the solenoid 33', the development of the image by the black toner is completed.

It is to be noted here that the rapid lowering of the image density upon raising of the developing bias voltage $V_b'$ may be attributable to a reduction of potential difference between the developing bias voltage $V_B'$ and the surface potential of the photoreceptor drum 1.

On the other hand, the image at the region B reproduced by the color toner is gradually raised in its density from the time point (a) at which the solenoid 33 is turned off, and thereafter, is rapidly raised in the density thereof at the time point (b) at which the developing bias voltage $V_B$ is changed over from $V_{B2}$ to $V_{B1}$, with simultaneous energization of the motor 24, and subsequently, is maintained at a constant density.

Therefore, at the boundary portion between the regions A and B, the black toner and color toner are to be superposed each other, but since the density of the color toner to be overlapped the black toner image is very low, while that of the black toner to be overlapped the color toner image is also low, the mixing of color is not particularly conspicuous. Meanwhile, owing to the fact that the image density of the black toner is rapidly lowered, while the image density of the color toner is rapidly raised conversely with respect to the boundary portion, the image is clearly reproduced at the boundary.

Meanwhile, at the terminating end portion of the color image, the image density is rapidly lowered at the time point (e) when the developing motor 24 is stopped and the developing bias voltage $V_B$ is changed over from $V_{B1}$ to $V_{B2'}$ and thereafter, the low image density is gradually lowered further up to the time point (f) when the solenoid 33 is turned on, with the development by the color tone being completed immediately thereafter.

On the other hand, the image at the region C reproduced by the black toner is gradually raised in its density from the time point (g) at which the solenoid 33' is turned off, and thereafter, is rapidly raised in the density thereof at the time point (h) at which the developing bias voltage is changed over from $V_{B2}'$ to $V_{B1}'$, with simultaneous energization of the motor 24', and subsequently, is maintained at a constant density.

Therefore, at the boundary portion between the regions B and C, the black toner and color toner are to be superposed each other in the similar manner as in the boundary portion between the regions A and B but since the density of the color toner to be mixed with the black toner image and that of the black toner to be mixed with the color toner image are extremely low, the mixing of color is not particularly conspicuous. Meanwhile, owing to the fact that the image density of the color toner is rapidly lowered, while the image density of the black toner is rapidly raised on the contrary with respect to the boundary portion, the image is clearly reproduced at the boundary.

As described above, in the vicinity of the boundary portions between the regions A and B, and between the regions B and C, the images at both sides with respect to the boundary portion are clearly reproduced without any chipping or loss, with the color mixing thereat being so small as not to be conspicuous.

As is clear from the foregoing description, in the image forming apparatus according to the above embodiment, images of neighboring different colors are clearly reproduced without being lost at any portions, while the color mixing thereat becomes almost inconspicuous in the actual images.

(SECOND EMBODIMENT)

Figure 13:
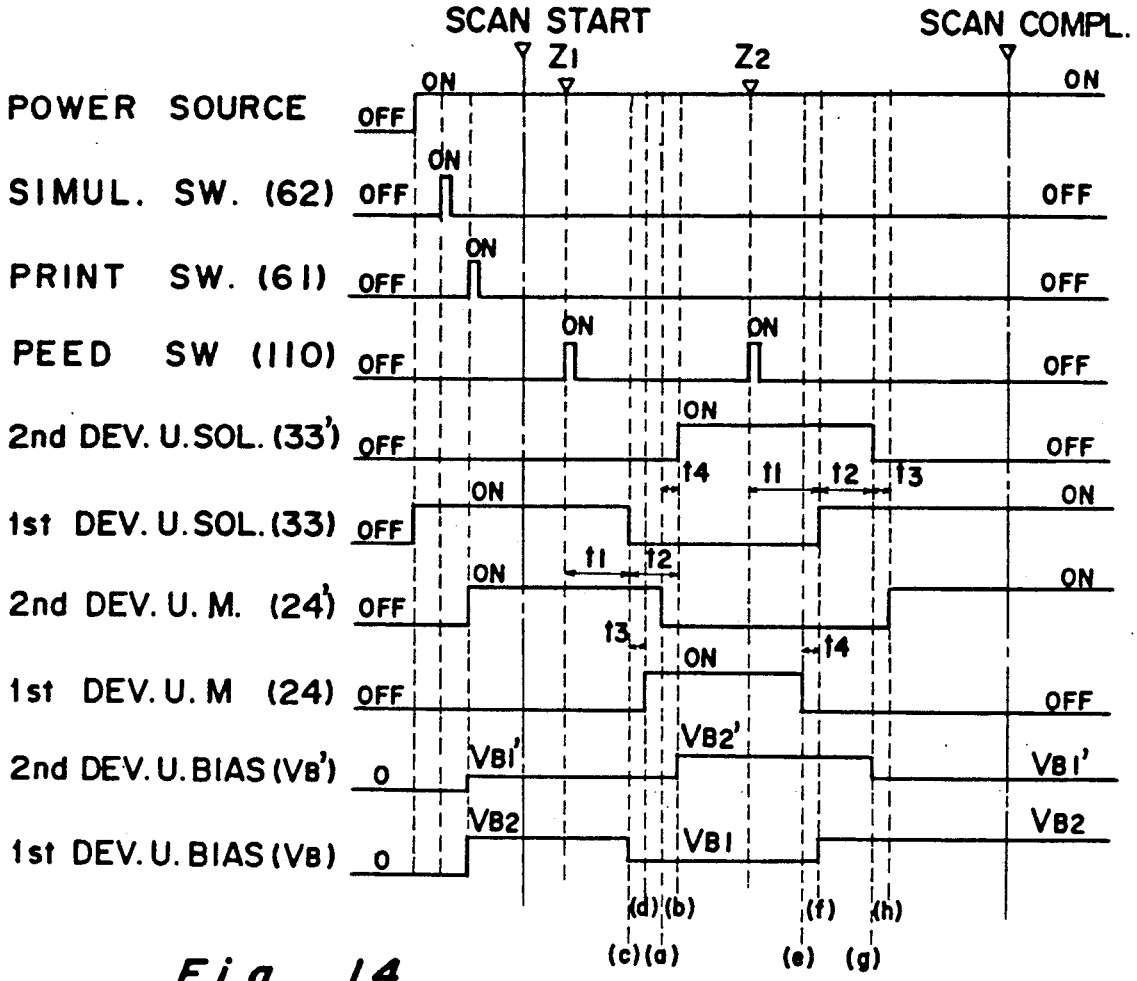
FIG. 13 is a time chart similar to FIG. 11, which particularly to a second embodiment of the present invention.

Since the constructions of the image forming apparatus for the second embodiment of the present invention are generally similar to those of FIGS. 1 to 10 for the first embodiment as described so far, detailed description thereof is abbreviated here for brevity of explanation. The essential points in which the second embodiment differs from the first embodiment, reside in the time chart in FIG. 13 for the control of the copying apparatus, particularly, in the first developing bias voltage $V_B$ and the second developing bias voltage $V_B'$, and therefore, such different points will be described in detail hereinafter.

After a time period t1=0.22 sec. from the turning on of the reed switch 110, upon arrival of the boundary portion Z1 of the electrostatic latent image, at the developing region X1, the first developing unit solenoid 33 is turned off, whereby the magnet roller 13 of the first developing unit 4 is rotated counterclockwise to be set in the state as shown in FIG. 4, with the developing bias voltage $V_B$ being reduced from $V_{B2}=300V$ to $V_{B1}=150V$.

Subsequently, after a time period t3=0.08 sec. from off function of the solenoid 33, the developing motor 24 is turned on and the first developing unit 4 is set as shown in FIGS. 4 and 5 in the similar state as in the second developing unit 5, whereby the developing sleeve 12, the supply roller 14 and the screw 15 are respectively rotated in the directions indicated by the arrows b, c, and d, with the magnetic brush being formed on the surface of the developing sleeve 12 so as to be set in the state ready to develop the electrostatic latent image on the surface 1*a* of the photoreceptor drum 1. Thus, at the first developing unit 4, supply of the color toner to the electrostatic latent image corresponding to the region B is started.

The reason why the start timing of the motor 24 is delayed by the time period t3 from the off timing of the solenoid 33 is as follows.

Specifically, upon rotation of the magnet roller 13 in the counterclockwise direction based on the turning off of the solenoid 33, the developer on the developing sleeve 12 is subjected to a transport force in the clockwise direction as indicated by the arrow b following movement of the magnetic poles thereof. Moreover, the developer is also subjected to a transport force in the direction of the arrow b also by the rotation of the developing sleeve 12.

Accordingly, if the on timing of the developing sleeve 12 coincides with the off timing of the solenoid 13, or when the solenoid 13 is turned off during rotation of the developing sleeve 12, the developer is temporarily subjected to a very large centrifugal force so as to be scattered towards the photoreceptor drum 1.

Therefore, it is so arranged to prevent the developer from scattering through reduction of the centrifugal force acting on the developer, by moving the magnetic poles through rotation of the magnet roller 13 first, and then, rotating the developing sleeve 12.

Subsequently, after a time t2-t4 (t4=0.08 sec.) from the off timing of the solenoid 33, namely, at a time point earlier by a time t4 than the time t2=0.20 sec. in which the boundary portion Z1 of the electrostatic latent image has moved from the developing region X1 to the developing region X2 for the second developing unit 5, the motor 24' of the second developing unit 5 is turned off, and the solenoid 33' is turned on after the time t4 therefrom. Simultaneously with the on function of the solenoid 33', the developing bias voltage $B_B'$ is changed over from $V_{B1}'=150V$ to $V_{B2}'=300V$, whereby the second developing unit 5 is set to the state as shown in FIGS. 6 and 7, and the intermediate portion between the magnetic poles N1 and S1 confronts the photoreceptor drum 1, and the developing sleeve 12', the supply roller 14', and the screw 15' stop rotations. Thus, the developing operation of the image of the region A by the black toner is completed.

When the scanner 40 further moves and reaches the position where the second lever 102 is located, namely, when the scanner 40 is at the boundary Z2 between the regions B and C the reed switch 110 is turned on upon detection of the magnet 102*a* and a signal is inputted to the control device CPU. At this time, the electrostatic latent image corresponding to the boundary Z2 is positioned at the exposure point W.

At the time t1-t4 after the reed switch 110 has been turned on, namely, at a time point earlier by the time t4 than when the electrostatic latent image of the boundary Z1 arrives at the developing region X1, the motor 24 of the first developing unit 4 is turned off, and the solenoid 33 for the first developing unit 4 is turned on after the time t4 therefrom, with the developing bias voltage $V_B$ being changed over from $V_{B1}=150V$ to $V_{B2}=300V$. Thus, the developing operation of the image of the region B in color is completed.

After the time t2 from the on function of the solenoid 33, namely, when the boundary Z2 of the electrostatic latent image positioned at the developing region X has arrived at the developing region X2 of the second developing unit 5, the solenoid 33' for the second developing unit 5 is turned off, while the developing bias voltage $V_B'$ changed over form $V_{B2}'=300V$ to $V_{B1}=150V$. Then, after the time t3 therefrom, the motor 24' for the second developing unit 5 is started.

As described above, since the start timing of the motor 24' is delayed by the time period t3 from the off timing of the solenoid 33' also with respect to the region C in the similar manner as in the developing starting time for the region B, there is no possibility that the developing material scatters from the developing sleeve 12' towards the photoreceptor drum 1.

Thus, the developing function of the second developing unit 5 is maintained up to the termination of the scanning, thereby to complete the development with respect to the region C.

By the foregoing operations, the two-color composite copy may be obtained in which the developing color is changed from black to color, and further to black, during the period from starting of the scanning to the completion thereof.

Figure 14:
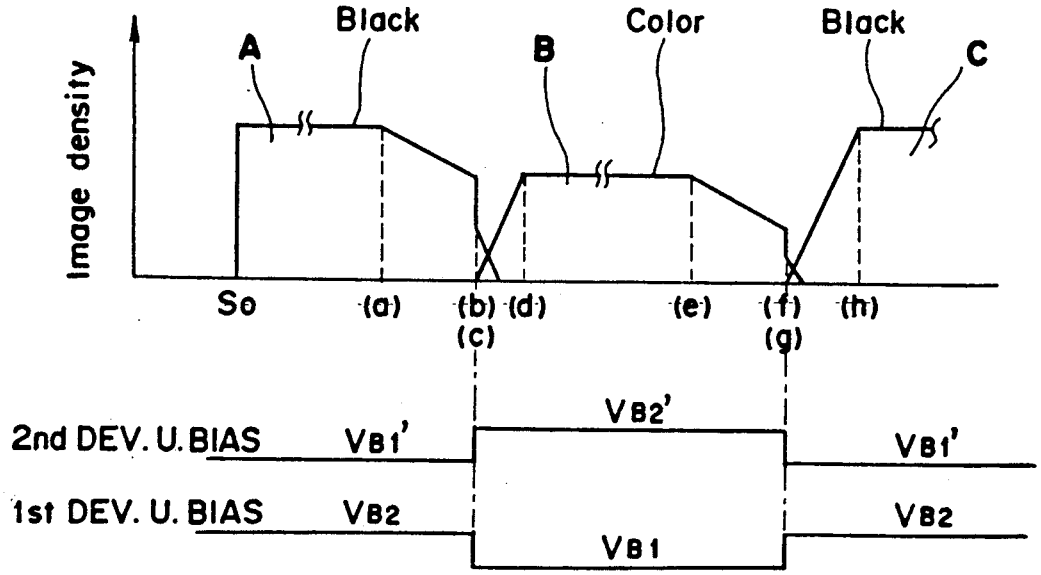
FIG. 14 is a diagram similar to FIG. 12, which particularly relates to the second embodiment of FIG. 13.

In FIG. 14, there is shown a diagram showing an image density of the two color composite copy in the direction of scanning, in which the symbol So represents a point corresponding to the leading edge of an original document S and coinciding with the leading edge 90*a* of the original document placing platform 9. Meanwhile, symbols (a) to (h) denote time points as follows also indicated in a time chart of FIG. 13.

(a) Off time point of the developing motor 24'.
(b) On time point of the solenoid 33', and change-over time point of the developing bias voltage $V_b'$ from $V_{B1}'$ to $V_{B2}'$.
(c) Off time point of the solenoid 33, and change-over point of the developing bias voltage $V_B$ from $V_{B2}$ to $V_{B1}$.
(d) On time point of the developing motor 24.
(e) Off time point of the developing motor 24.
(f) On time point of the solenoid 33, and change-over time point of the developing bias $V_B$ form $V_{B1}$ to $V_{B2}$.
(g) Off time point of the solenoid 33', and change-over time point of the developing bias $V_B'$ from $V_B2'$ to $V_{B1}'$.
(h) On time point of the motor 24'.

As shown in FIG. 14, the image in the region A as developed by the black toner is reproduced by a constant density from the image leading edge So to the time point (a) at which the developing motor 24' stops. Upon stopping of the developing motor 24' at the time point (a), the image density is gradually lowered slowly, and at the time point (b) when the developing bias voltage $V_B'$ is changed over from $V_{B1}'$ to $V_{B2}'$, with turning on of the solenoid 33', the image density is rapidly lowered with a subsequent lowering at a comparatively sharp slope. Although the image density is comparatively high from the time point (a) to the time point (b) and the image in this region is clearly reproduced, the image in the region after the time point (b) becomes very low in the density.

It is to be noted here that the rapid lowering of the image density upon raising of the developing bias voltage $V_B'$ is attributable to a reduction of potential difference between the developing bias voltage $V_B'$ and the surface potential of the photoreceptor drum 1.

On the other hand, the image at the region B reproduced by the color toner is rapidly raised in its density from the time point (c) at which the solenoid 33 is turned off and the developing bias voltage $V_B$ is changed over from $V_{B2}$ to $V_{B1}$ and subsequently, is maintained generally at a constant density from the time point (d) at which the rotation of the motor 24 is started. From the time point (e) when the developing motor 24 is stopped, the image density is gradually lowered slowly, and at the time point (f) when the solenoid 33 is turned on, with simultaneous change-over of the developing bias voltage $V_B$ from $V_{B1}$ to $V_{B2}$, the image density is rapidly lowered for subsequent reduction in a comparatively sharp slope. Although the image density is comparatively high from the time point (e) to (f) and the image in this region is clearly reproduced, the image in the region after the time point (f) becomes very low in the density.

Subsequently, the image at the region C reproduced by the black toner is rapidly raised in its density from the time point (g) at which the solenoid 33' is turned off, and the developing bias voltage $V_B'$ is changed over from $V_{B2}'$ to $V_{B1}'$, and is maintained at a generally constant density from the time point (h) when the rotation of the motor 24' is started.

As described above, at the boundary portions between the regions A and B, and between the regions B and C, terminating ends of the regions before the boundary portions are clearly represented, while the starting end of the image in the region after the boundary portion is also raised in density, and therefore, color mixing does not take place at the boundary portion, with the width of a faulty image thereat being so narrow that it is hardly noticeable in the actual image.

As is seen from the above description, according to the image forming apparatus of the second embodiment, the starting end and the terminating end of the image are clearly reproduced even when the developing unit is changed over from the developing state to the non-developing state or conversely, from the non-developing state to the developing state. Moreover, even when it is so arranged to reproduce one sheet of original document in a plurality of colors by driving a plurality of developing units during one image forming operation, the boundary portions for the image in different colors may be definitely reproduced, with the image density being favorably maintained.

(THIRD EMBODIMENT)

Figure 15:
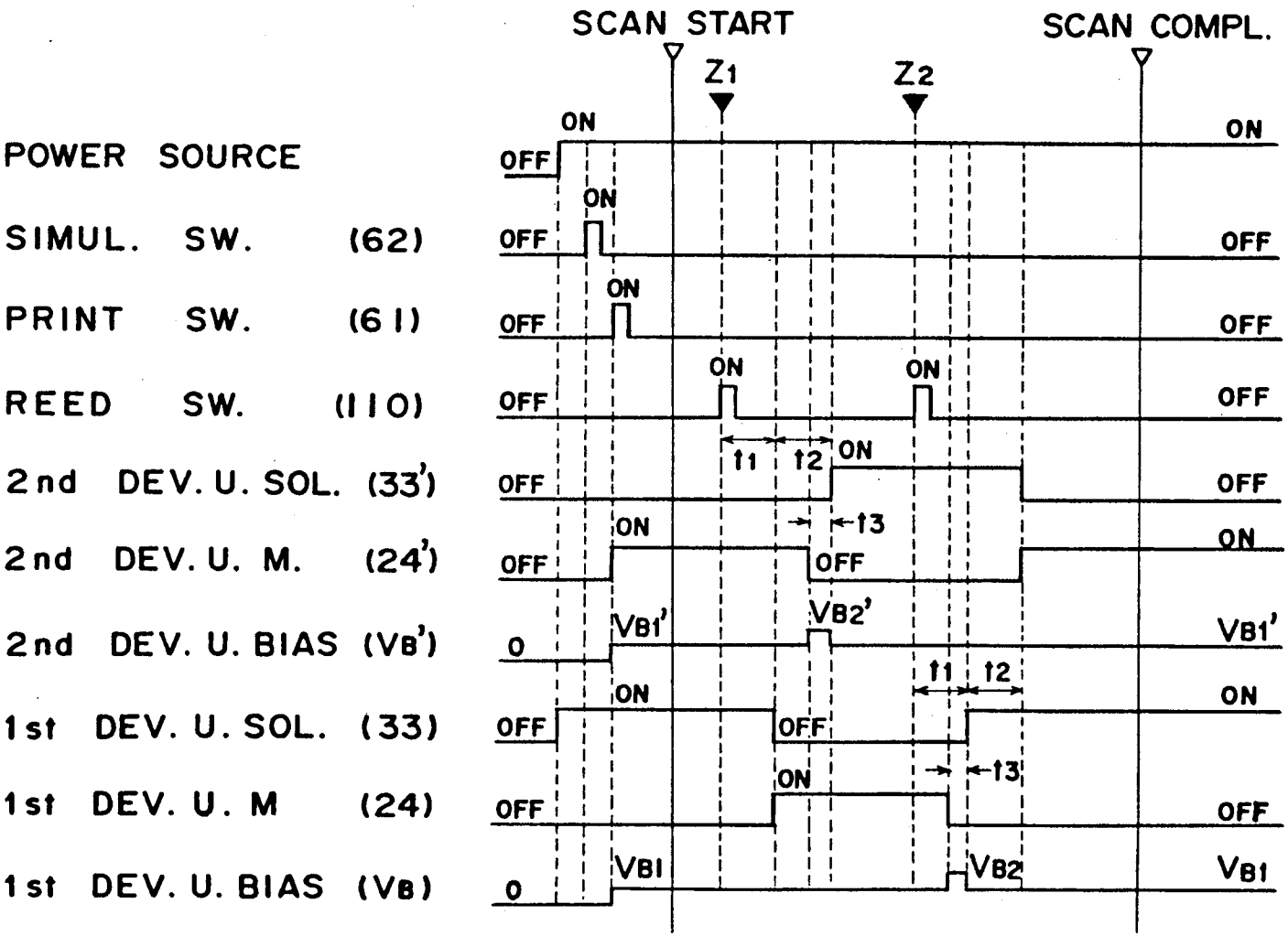
FIG. 15 is another time chart similar to FIG. 11, which particularly relates to a third embodiment according to the present invention.

Due to the fact that the constructions of the image forming apparatus for the third embodiment of the present invention are generally similar to those of FIGS. 1 to 10 for the first embodiment as described earlier, detailed description thereof is abbreviated here for brevity of explanation. Since the main points in which the third embodiment differs from the first embodiment, reside in the time chart in FIG. 15 for the control of the copying apparatus, the control function of the control unit CPU will be described hereinbelow by referring to FIGS. 10 and 15, with respect to the case for effecting the simultaneous multi-color copying for the components and bias voltages for the second developing unit 5, primes are affixed to the numerals for differentiation from those for the first developing unit 4.

When the main switch (not shown) of the copying apparatus G is turned on, the solenoid 33 is energized, and as shown in FIG. 6, the intermediate portion between the magnetic poles N1 and S1 of the first developing unit 4 confronts the photoreceptor drum 1, while .in the second developing unit 5, the solenoid 33' is in the off state, and as shown in FIG. 4, the magnetic pole N1 confronts the photoreceptor drum 1.

When the print key 61 FIG. 8 is turned on in this state, the second developing unit 5 housing a black toner is automatically driven, thereby the standard copying operation being carried out. When the simultaneous multi-color copy switch 62 is turned on in this state, the simultaneous multi-color copying mode is set in a state ready to be effected. It is to be noted, however, that even if the simultaneous multi-color copy switch 62 is depressed during the copying operation, it does not function at all.

When the simultaneous multi-color switch 62 is turned on during standing-by of the copying apparatus, the copy mode is switched from the standard copy mode to the simultaneous multi-color copying mode.

In this state, the first and second levers 101 and 102 are slid along the slide groove 103 so as to specify the image of the regions A and C to be reproduced in monochrome and the image of the region B to be reproduced in color as shown in FIG. 8.

The levers 101 and 102 are arranged to function only when the simultaneous multi-color copying mode is specified, and thus, can not function in a state other than that. When the print key 61 is turned on in the state as described above with an original document S placed on the original document placing platform 9, as shown in FIG. 8, the developing bias voltages $V_B$ and $V_B'$ for the developing units 4 and 5 are set to $V_{B1}$ and $V_{B1}'$ from 0 V respectively. These bias voltages $V_{B1}$ and $V_{B1}'$ are respectively set at 150V when the surface potential of the photoreceptor drum 1 charged by the corona charger 2 is at 500V.

In the second developing unit 5, the developing motor 24' of the second developing unit 5 started by the drive control means, whereby the developing sleeve 12', supply roller 14', and screw 15' are rotated in the directions b, c, and d shown by arrows.

By the operations of these components of the second developing unit 5, the developer containing a black toner and housed in a developing tank 11' is mixed and stirred through rotation of the supply roller 14' and the screw 15' while the developer is being transported along the transport passages 16' and 17'. During the transportation, part of the developer is supplied to the surface of the developing sleeve 12' by the supply roller 14' so as to form a magnetic brush on the developing sleeve 12'.

The developer in the form of a magnetic brush is fed to the developing region X2 by the rotation of the developing sleeve 12', and passes through the bristle height restricting gap Db, with a specified amount of developer being regulated or cut off by the magnetic brush bristle height regulating plate 19'. Thereafter, the developer is sequentially transported to the developing region X2 so as to contact the surface 1a of the photoreceptor drum 1 at a predetermined width, and thus, an electrostatic latent image formed on the surface 1a of the photoreceptor drum 1 at the region X2, is set in a state to be developed by the developer.

When the print key 61 is turned on, the scanner 40 starts scanning the image of the original document S in the direction shown by the arrow b. The surface of the photoreceptor drum 1 is irradiated by the light reflected from the original document S placed on the original document platform 9 through the exposure point W, thus an electrostatic latent image being formed. Thereafter, the second developing unit 5 first starts developing the electrostatic latent image.

When the magnet 101a of the first lever 101 is detected by the reed switch 110 mounted on the scanner 40, a signal is inputted by the reed switch 110 to the control unit CPU.

At this time, the electrostatic latent image, corresponding to the boundary Z1, between the region A and the region B, at which the copy mode is changed from the first copy mode to the second copy mode, namely, from black to colors (red or yellow) is positioned at the exposure point W on the photoreceptor drum 1. During the period (T1=0.22 sec) in which the boundary Z1 moves from the exposure point W to the developing region X1 of the first developing unit 4, only the second developing unit 5 operates.

When the electrostatic latent image at the boundary portion Z1 reaches the developing region X1 after the time t1 when the reed switch 110 is turned on, the solenoid 33 for the first developing unit 4 is turned off, whereby the magnet roller 13 of the first developing unit 4 is rotated counterclockwise and set to the condition as shown in FIG. 4 capable of effecting developing, while the motor 24 of the drive means 20 is turned on so that the developing sleeve 12, the supply roller 14, and the screw 15 are rotated in the directions shown by the arrows b, c, and d, with the result that a magnetic brush is formed on the surface of the developing sleeve 12 and the electrostatic latent image formed on the photoreceptor drum 1 is ready t be developed. Thereafter, the first developing unit 4 starts supplying a color toner (red or yellow) to the electrostatic latent image corresponding to the region B.

After passing the time t2–t3 from the start of the first developing motor 24 for the first developing unit 4, namely, at a time point earlier by a time t3=0.05 sec. than the time t2=0.2 sec. in which the boundary Z1 of the electrostatic latent image has moved from the developing region X1 of the first developing unit to the developing region X2 of the second developing unit 5, the motor 24' of the second developing unit 5 is turned off, and the developing bias voltage $V_B'$ of the second developing unit 5 is changed over from $V_{B1}'=150V$ to $V_{B2}'=300V$ to increase the restricting force for the toner.

After the time t3 from the turning off of the motor 24' for the second developing unit 5, the bias voltage $V_B'$ is changed over to $V_{B1}'$, and simultaneously the solenoid 33' for the second developing unit 5 is turned on, whereby the second developing unit 5 is set to the state as shown in FIGS. 6 and 7, and the middle portion between the magnetic poles N1 and S1 confronts the photoreceptor drum 1, and the developing sleeve 12', the supply roller 14', and the screw 15' stop rotations. Thus, the developing operation of the image of the region A by a black toner is completed.

As described above, in the second developing unit 5, since the developing sleeve 12' is stopped, and the supply roller 13' is rotated under the state in which the restricting force for the toner is large, there is no possibility that toner scatters towards the photoreceptor drum 1.

When the scanner 40 further moves and reaches the position where the second lever 102 is located, namely, when the scanner 40 is at the boundary Z2 between the regions B and C, the reed switch 110 is turned on upon detection of the magnet 102a and the signal is inputted to the control unit CPU. At this time, the electrostatic latent image corresponding to the boundary Z2 is positioned at the exposure point W.

After the time t1–t3 after the reed switch 110 has been turned on, namely, at a time point earlier by the time t3 than when the electrostatic latent image of the boundary Z2 arrives at the developing region X, the motor 24 of the first developing unit 4 is turned off and the developing bias voltage $V_B$ is changed over from $V_{B1}=150V$ to $V_{B2}=300V$. Meanwhile, after the time t3 from the turning off of the motor 24, the developing bias voltage $V_B$ is changed over to $V_{B1'}$ and the solenoid 33 for the first developing unit 4 is turned on. Thus, the developing operation of the image of the region B in color is completed.

As described above, in the second developing unit 4, since the developing sleeve 12 is stopped, and the supply roller 13 is rotated under the state in which the restricting force for the toner is large, there is no possibility that the toner scatters towards the photoreceptor drum 1 in the similar manner as in the developing completion for the region A as described earlier.

After the time t2 from the turning on of the solenoid 33, the solenoid 33 of the second developing unit 5 is turned off, and further, after the time t3 therefrom, i.e., when the electrostatic latent image corresponding to the boundary portion Z2 and located at the developing region X2 for the second developing unit 5, the motor 24' of the second developing unit 5 is started to begin developing for the region C, and the developing function is maintained for a predetermined period of time even after completion of the scanning.

By the foregoing operations, the two-color composite copy may be obtained in which the developing color is changed over from black to color, and further to black during the period from starting of the scanning and the completion thereof.

It should be noted here that, in the foregoing embodiments, although the description has been given with respect to the case where the present invention is applied to the image forming apparatus for effecting the simultaneous multi-color copying, the concept of the present invention is not limited in its application t the above embodiments alone, but may be applied to any image forming apparatus so far as it is provided with the function to develop only the designated region by changing over the magnet roller from the developing position to the non-developing position through rotation thereof in the course of the image formation.

It should also be noted that, in the foregoing embodiments, although the magnet roller is arranged to be rotated in the rotating direction of the developing sleeve during transfer from the developing position to the non-developing position, such rotating direction may be reversed depending on necessity.

It should further be noted that although the foregoing embodiments are related to the image forming apparatus of the regular developing system in which the electrostatic latent image formed on the photoreceptor surface is to be developed by the toner having a polarity opposite to that of said electrostatic latent image, the present invention may also be applied to a reversal development in which the electrostatic latent image is developed by toner having the same polarity as that of said electrostatic latent image. In the embodiments of the regular developing system as described earlier, the developing bias is arranged to be increased for changing from the developing state to the non-developing state, but in the case of the reversal developing system, it may be so arranged to reduce the developing bias.

As is clear from the foregoing description, in the image forming apparatus according to the third embodiment of the present invention, it is so arranged to change over the developing sleeve from the developing state to the non-developing state, during transfer of the developing unit from the developing state to the non-developing state in the image forming function, and thereafter, to change over the magnet roller from the developing state to the non-developing state.

Accordingly, there is no possibility that toner scatters from the developing sleeve to the electrostatic latent image holding member, and thus, clear and definite images free from toner scattering patterns or the like may be obtained.

Although the present invention has been fully described by way of example with reference to the accompanying drawings, it is to be noted here that various changes and modifications will be apparent to those skilled in the art. Therefore, unless otherwise such changes and modifications depart form the scope of the present invention, they should be construed as included therein.

What is claimed is:

1. An image forming apparatus arranged to develop an electrostatic latent image formed on an electrostatic latent image holding member by use of toner, said image forming apparatus comprising:

a developing sleeve rotatably provided to confront the electrostatic latent image holding member, a sleeve driving means for rotating said developing sleeve, a magnet roller provided within said developing sleeve and having a plurality of magnetic poles, a magnet roller driving means for rotating said magnet roller through a predetermined angle, said magnet roller driving means being arranged to rotate said magnet roller between a first state where a magnetic pole thereof confronts the electrostatic latent image holding member and a second state where an intermediate portion between neighboring magnetic poles confronts said electrostatic latent image holding member, and a control means for controlling said sleeve driving means and said magnet roller driving means in such a manner as to rotate the magnetic poles of said magnet roller from the first state to the second state after stopping rotation of said developing sleeve when the developing function is to be completed.

2. An image forming apparatus as claimed in claim 1, further comprising means for applying a bias voltage to the developing sleeve, and a bias voltage control means for controlling said bias voltage applying means so as to change an amount of the bias voltage applied to the developing sleeve from a first value to a second value upon stopping rotation of said developing sleeve, the first value being closer to zero than the second value.

3. An image forming apparatus as claimed in claim 2, wherein said bias voltage control means is adapted to control said bias voltage applying means so as to further change the amount of the bias voltage from the second value to a third value following rotation of said magnet roller, the third value being closer to zero than the second value.

4. An image forming apparatus as claimed in claim 1, further comprising means for applying a bias voltage to the developing sleeve, and a bias voltage control means for controlling said bias voltage applying means so as to change an amount of the bias voltage applied to the developing sleeve from a first value to a second value following rotation of said magnet roller, the first value being closer to zero than the second value.

5. An image forming apparatus as claimed in claim 1, further comprising means for applying a bias voltage to the developing sleeve, and a bias voltage control means for controlling said bias voltage applying means so as to change an amount of the bias voltage applied to the developing sleeve from a first value to a second value upon stopping rotation of said developing sleeve for preventing the toner from adhering to the electrostatic latent image.

6. An image forming apparatus as claimed in claim 5, wherein said bias voltage control means is adapted to control said bias voltage applying means so as to further change the amount of the bias voltage from the second value to a third value following rotation of said magnet roller, the third value being equal to the first value.

7. An image forming apparatus arranged to develop an electrostatic latent image formed on an electrostatic latent image holding member, said image forming apparatus comprising:

a developing sleeve rotatably provided to confront the electrostatic latent image holding member, a sleeve driving means for rotating said developing sleeve, a magnet roller provided within said developing sleeve and having a plurality of magnetic poles, a magnet roller driving means for rotating said magnet roller through a predetermined angle, said magnet roller driving means being arranged to rotate said magnet roller between a first state where a magnetic pole thereof confronts the electrostatic latent image holding member and a second state where an intermediate portion between neighboring magnetic poles confronts said electrostatic latent image holding member, means for applying a bias voltage to said developing sleeve, and control means for controlling said sleeve driving means and said magnet roller driving means so as to start rotation of the developing sleeve after having rotated the magnetic poles of said magnet roller from said second state to said first state when the developing function is to be started, and also for controlling said bias voltage applying means so as to change an amount of the bias voltage applied to said developing sleeve from a first value to a second value upon starting rotation of said developing sleeve, the second value being closer to zero than the first value.

8. An image forming apparatus arranged to develop an electrostatic latent image formed on an electrostatic latent image holding member, said image forming apparatus comprising:

a developing sleeve rotatably provided to confront the electrostatic latent image holding member, a sleeve driving means for rotating said developing sleeve, a magnet roller provided within said developing sleeve and having a plurality of magnetic poles, a magnet roller driving means for rotating said magnet roller through a predetermined angle, said magnet roller driving means being arranged to rotate said magnet roller between a first state where a magnetic pole thereof confronts the electrostatic latent image holding member and a second state where an intermediate portion between neighboring magnetic poles confronts said electrostatic latent image holding member, means for applying a bias voltage to said developing sleeve, and control means for controlling said sleeve driving means and said magnet roller driving means so as to start rotation of the developing sleeve after having rotated the magnetic poles of said magnet roller from said second state to said first state when the developing function is to be started, and also for controlling said bias voltage applying means so as to change an amount of the bias voltage applied to said developing sleeve from a first value to a second value following rotation of said magnet roller, the second value being closer to zero than the first value.

9. An image forming apparatus arranged to develop an electrostatic latent image formed on an electrostatic latent image holding member, said image forming apparatus comprising:

a developing sleeve rotatably provided to confront the electrostatic latent image holding member, a sleeve driving means for rotating said developing sleeve, a magnet roller provided within said developing sleeve and having a plurality of magnetic poles, a magnet roller driving means for rotating said magnet roller through a predetermined angle, said magnet roller driving means being arranged to rotate said magnet roller between a first state where a magnetic pole thereof confronts the electrostatic latent image holding member and a second state where an intermediate portion between neighboring magnetic poles confronts said electrostatic latent image holding member, and a control means for controlling said sleeve driving means and said magnet roller driving means in such a manner as to rotate the magnetic poles of said magnet roller from the first state to the second state after passing a predetermined period of time subsequent to stopping rotation of said developing sleeve when the developing function is to be completed.

* * * * *